US011821157B2

(12) United States Patent
Bucarizza

(10) Patent No.: US 11,821,157 B2
(45) Date of Patent: Nov. 21, 2023

(54) RESTRICTIVE BARRIER

(71) Applicant: COCHRANE USA INC., Alexandria, VA (US)

(72) Inventor: Vlado Bucarizza, Dubai (AE)

(73) Assignee: COCHRANE USA INC., Alexandria, VA (US)

( * ) Notice: Subject to any disclaimer, the term of this patent is extended or adjusted under 35 U.S.C. 154(b) by 0 days.

(21) Appl. No.: 17/329,378

(22) Filed: May 25, 2021

(65) Prior Publication Data

US 2021/0372066 A1 Dec. 2, 2021

Related U.S. Application Data

(60) Provisional application No. 63/029,951, filed on May 26, 2020.

(51) Int. Cl.
*E02B 3/06* (2006.01)

(52) U.S. Cl.
CPC ..... *E02B 3/062* (2013.01)

(58) Field of Classification Search
CPC .. E02B 3/062; E02B 15/0814; E02B 15/0835; F41H 11/05; B63G 9/04
See application file for complete search history.

(56) References Cited

U.S. PATENT DOCUMENTS 4,688,024 A * 8/1987 Gadde ..... F41H 11/05 405/303
4,962,619 A * 10/1990 Chatten ..... A01M 29/32 256/52
8,297,884 B1 * 10/2012 Khachaturian ..... B63B 35/00 405/195.1
2001/0048851 A1 * 12/2001 Dreyer ..... E02B 15/0814 405/63
2011/0236139 A1 * 9/2011 Masaki ..... B63B 22/00 405/211
2014/0112719 A1 * 4/2014 Nakaishi ..... E02B 15/02 405/80
2014/0306170 A1 * 10/2014 Smith ..... F41H 11/05 256/13
2015/0294541 A1 * 10/2015 Wilson ..... G08B 13/124 340/550
2016/0017559 A1 * 1/2016 Rasmussen ..... E02B 15/0864 405/63
2018/0080744 A1 * 3/2018 Osienski ..... F41H 11/05
2018/0179718 A1 * 6/2018 Lee ..... C02F 1/40
2019/0137225 A1 * 5/2019 Terai ..... E02B 17/0017
2020/0123726 A1 * 4/2020 Kim ..... E02B 15/0807

FOREIGN PATENT DOCUMENTS

CN 205688405 * 11/2016 ..... Y02A 30/30
WO WO-2009152533 A1 * 12/2009 ..... B63B 22/00

* cited by examiner

*Primary Examiner* — Carib A Oquendo

(74) *Attorney, Agent, or Firm* — Wenderoth, Lind & Ponack, L.L.P.

(57) ABSTRACT

A barrier for restriction of passage across or through a body of water, the barrier including a plurality of interconnected buoyant bodies which are spaced apart from one another in a longitudinal array, a plurality of deterrent components on or between the buoyant bodies and obstructive material which in use extends downwardly from the buoyant bodies.

14 Claims, 18 Drawing Sheets

RESTRICTIVE BARRIER

BACKGROUND OF THE INVENTION

This invention relates to a barrier for restricting passage by a person or watercraft across or through a body of water e.g. a harbour, a marine installation, a dam, a lake or a river.

For example it is fairly common for a river to form a boundary between two adjacent countries. Notionally at least, a line along a middle point in the river demarcates one country from the other. If the river is long then it can be difficult to police the river to ensure that unauthorised passage from one country through or across the river to an adjacent country does not occur. The erection of a fence or wall on one bank of the river might achieve this objective but this type of structure is unsightly, hinders normal usage of the river and can be prone to being damaged or swept away when the river rises due to heavy rains or seasonal factors.

The provision of a barrier to restrict passage across or through a river, from one river bank, to the other river bank can therefore be problematic. Similar problems arise when a location or area, adjacent or bounded by a body of water, must be protected or safeguarded.

An object of the present invention is to address, at least to some extent, the aforementioned situation.

SUMMARY OF THE INVENTION

The invention provides a barrier for restriction of passage across or through a body of water, the barrier including a plurality of interconnected buoyant bodies which are spaced apart from one another in a longitudinal array, and a plurality of deterrent components on or between the buoyant bodies.

Obstructive material may in use extend downwardly from the buoyant bodies.

The buoyant bodies may be positioned in an elongate line along the length of the longitudinal array. In a different embodiment of the invention the buoyant bodies are interconnected so that they form two or more spaced apart elongate lines which preferably are parallel to one another and which are interconnected.

The buoyant bodies form a barrier zone with a length which equals the length of the array and a width which is equal to a transverse dimension of the array.

Each buoyant body may have any suitable shape and for example may be cylindrical or spherical.

The deterrent components on the buoyant bodies may be outwardly extending spikes and may be integral with the bodies or may be separately formed and thereafter attached to the buoyant bodies.

The deterrent components between adjacent bodies may comprise a plurality of spikes.

In one embodiment adjacent bodies are interconnected by means of an elongate member and spikes or other deterrent components are attached thereto.

In one example the deterrent components include rings with outer serrated surfaces. The rings are mounted at spaced apart locations to outer surfaces of the buoyant bodies and are preferably rotatable relative to the buoyant bodies to which they are mounted.

The obstructive material which when used, is below the buoyant bodies and is intended to frustrate or inhibit a person from swimming through the water below the barrier. The obstructive material may be apertured so that it does not create too much drag against any current which may flow in the water. Additionally the use of apertured material lowers costs.

The obstructive material may be a plastics material or, if made from steel or other metal, may be protected if required against corrosion by the application of a suitable anti-rust material.

In one form of the invention the obstructive material is formed from a plurality of sheets of mesh. Preferably moving away from the buoyant bodies i.e. downwardly in use, the density of the mesh decreases. Thus adjacent the buoyant bodies the obstructive material may comprise first sheets of mesh material with a first mesh density and, suspended from or attached to these first sheets, second sheets of mesh material with a second mesh density which is less than the first mesh density.

The obstructive material may be attached to the buoyant bodies or to the elongate members which interconnect the buoyant bodies or to components between the buoyant bodies.

Preferably the obstructive material is pivotal relative to the buoyant bodies at least to a limited extent. If multiple sheets of mesh material are used then upper and lower sheets of mesh material may be pivotally movable relative to each other at least to a limited extent.

In a direction along the length of the longitudinal array edges of adjacent sheets of mesh material may overlap with one another so that a gap is not formed between the sheets which could facilitate underwater passage of a person.

The buoyant bodies may be anchored in position. This may be done in any appropriate way and preferably use is made of a plurality of cables, chains or other flexible elements which are attached at upper ends to the buoyant bodies or to components which, in turn, are attached to the buoyant bodies and which, at lower ends, are fixed to anchors placed in the ground above which is located the body of water e.g. the bed of a river. The elongate members may have a length which enables the buoyant bodies to move to a limited extent due to currents flowing in the body of water but which also allow the buoyant bodies to rise or drop as the level of the water changes e.g. due to rain, tides, or other seasonal effects. The elongate members may for example have a length which is approximately three times the depth of the water at the locations at which the anchors are positioned.

In a different form of the invention the obstructive material comprises coils which may be in a helical form or in a flat form. The latter configuration is achieved by taking a helical coil arrangement with a plurality of windings of suitable elongate material e.g. steel and then flattening adjacent windings one onto the other and securing them together so that the coil arrangement thus has a flat configuration.

The barrier may include blocking material at least on one side of the longitudinal array. The blocking material may be mesh, coils which may be flattened, or the like. The invention is not limited in that respect. Preferably the blocking material is located on both sides of the elongate array. The blocking material may be tied to rods or other supports so that the blocking material is close to a surface of the body of water in which the barrier is positioned. Alternatively or additionally the blocking material may be kept in a floating mode by means of one or more floats attached to the blocking material. An intention in this respect is that the overall density of the blocking material with the floats should be lowered so that the blocking material does not sink but remains more or less at a constant depth in the body of water. However if a person or a watercraft exerts weight on the blocking material then the blocking material is forced into the water and passage then becomes difficult. The blocking material which in use extends transversely to the obstructive material, thus makes it difficult for a watercraft to approach sufficiently closely to the barrier so that a person on the watercraft can cross over the barrier.

The invention also extends to a barrier module which includes at least two buoyant bodies which are interconnected, a first coupling formation at one end of the buoyant bodies, a second coupling formation which is at a second end of the buoyant bodies and which is complementary to and engageable with a similar first coupling formation on a similar barrier module, deterrent components on the buoyant bodies, and obstructive e.g. apertured, material which, in use, extends downwardly from the buoyant bodies.

Viewed from one side the first and second buoyant bodies are preferably spaced apart by a distance A and the apertured material has first and second ends which are spaced apart by a distance D and D is greater than A. This feature allows adjacent barrier modules to be connected to one another with the apertured material below the buoyant bodies in an overlapping configuration. The buoyant bodies may be interconnected by means of an elongate member. The coupling formations may be at ends of the elongate member or on stub axles or similar components which project from the buoyant bodies.

The components from which the barrier is made are positioned to define a barrier zone which has a height which is difficult to overcome. Additionally the barrier zone, through the use of the obstructive material, has a depth which makes it difficult for a person to pass underneath the barrier. A third factor is that the longitudinal array has a width viewed in plan which is transverse to the longitudinal direction in which the barrier extends. Ideally the width is such that even if a person can cross over, say, the buoyant bodies the width of the barrier zone is such that the person still faces a significant obstacle to overcome.

In one form of the invention the width of the barrier zone is effectively equal to the width of the buoyant bodies and the deterrent components which are attached thereto. This is the case particularly if the buoyant bodies are in a single line. However if the buoyant bodies are arranged in two or more spaced apart lines which may be parallel to one another then the space between the buoyant bodies may be relatively large. This carries with it the benefit that additional deterrent material can be placed between the lines of buoyant bodies to increase the width of the barrier zone.

Thus in another embodiment a plurality of buoyant bodies are arranged spaced apart from one another in a first line and a plurality of buoyant bodies are spaced apart from one another in a second line which is spaced from the first line.

The two lines of the buoyant bodies may be interconnected so that they are spaced apart by a suitable distance. First deterrent material may be positioned between the buoyant bodies extending, in use, in a longitudinal direction between the bodies and upwardly. The first deterrent material may be obstructive material e.g. mesh, coils or the like.

Second deterrent material e.g. apertured material, coils or the like may be secured directly or indirectly to one or both of the lines of buoyant bodies so that, in use, the second deterrent material extends downwardly. Alternatively the second deterrent material may be positioned more or less centrally between the two lines of buoyant bodies extending downwardly.

The buoyant bodies may be in the form of spherical buoys and may be spaced from one another in each line by a distance which exceeds the diameter of each spherical buoy. In a different embodiment the buoyant bodies are cylindrical in shape and are spaced fairly close to one another substantially in an end-to-end relationship.

The buoyant bodies, themselves, may carry deterrent components such as spikes. Additionally deterrent components, again in the form of spikes, may be positioned between the buoyant bodies.

The various features and configuration, described hereinbefore, may be combined with one another in any desired relationship.

BRIEF DESCRIPTION OF THE DRAWINGS

The invention is further described by way of examples with reference to the accompanying drawings in which.

DESCRIPTION OF PREFERRED EMBODIMENTS

Figure 1:
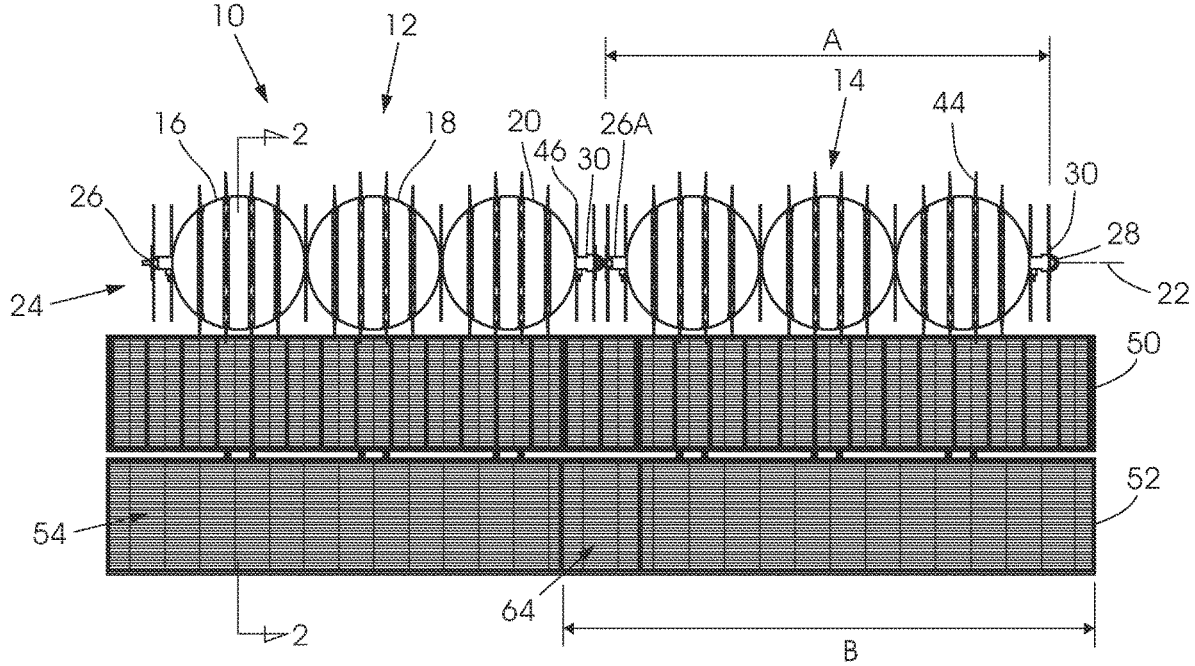
FIG. 1 is a side view of a barrier according to one form of the invention.

FIG. 1 of the accompanying drawings illustrates from one side a barrier 10 according to one form of the invention.

The barrier 10 is made up from a number of modules two of which, 12 and 14, are shown in FIG. 1. In this instance the modules are substantially identical to each other and only the module 12 is described hereinafter.

The module 12 includes three buoyant bodies 16, 18 and 20 respectively which are substantially identical to each other. Each buoyant body is spherical and is formed from a material which is less dense than water so that the buoyant body will float. The bodies 16, 18 and 20 are interconnected along a central axle line 22. A stub axle 24 protrudes to the left of the body 16 and has a first coupling formation 26. A stub axle 28 projects to the right of the body 20 and has a second coupling formation 30 which is complementary to the coupling formation 26. These features are also present in the barrier module 14. The coupling formation 30 can thus be readily connected to the coupling formation (designated 26A) on the module 14 so that the modules 12 and 14 can be coupled together. Additional modules can be interconnected in the same way so that an elongate string of the modules is formed in a body of water (not shown).

Figure 2:
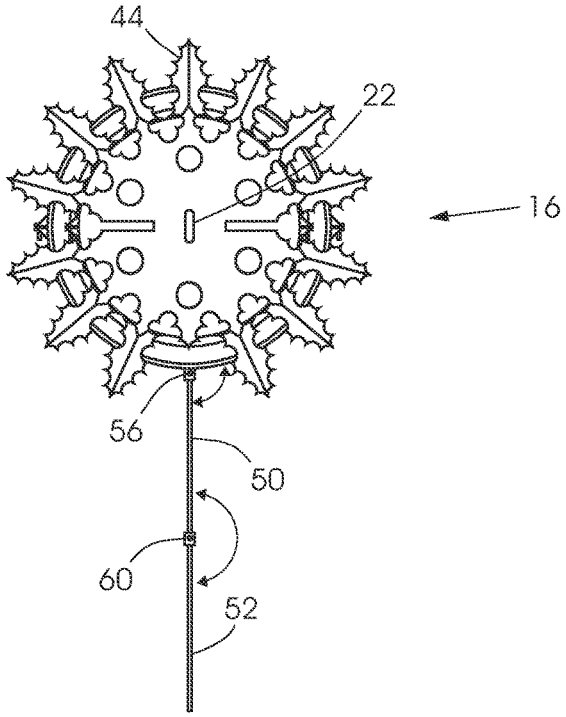
FIG. 2 is a view, in cross section, of the barrier taken on a line 2-2 in FIG. 1.
Figure 3:
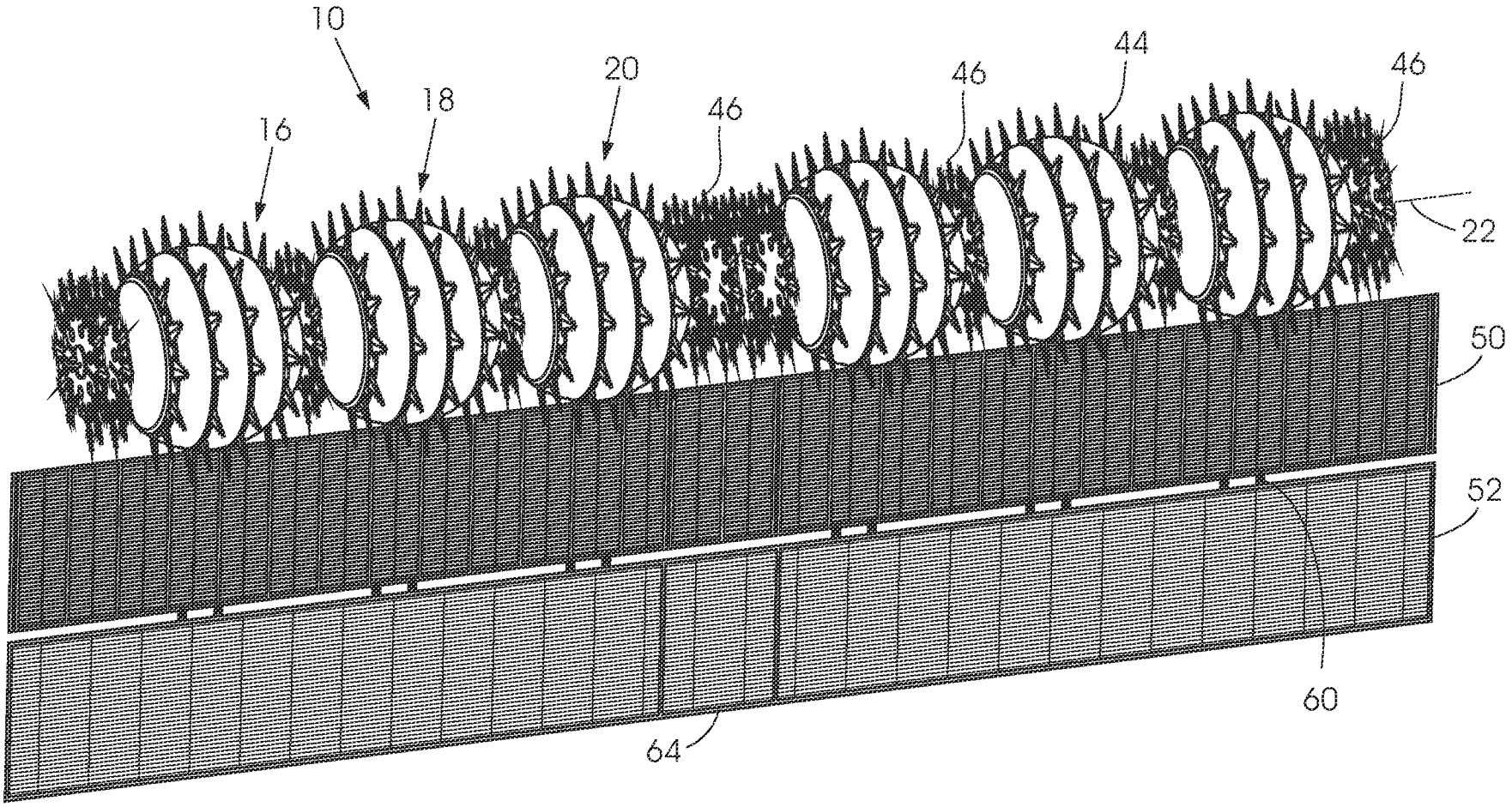
FIG. 3 is a perspective view of the arrangement shown in FIG. 1.

Each buoyant body carries a plurality of deterrent components, in this instance in the form of spikes 44—see FIG. 2 and FIG. 3. Additionally spikes 46 are attached to the stub axles 24 and 28. Thus the interconnected modules form a substantially impenetrable elongate assembly which, due at least to the nature of the coupling formations 26, 30, is flexible, to some degree, in a vertical sense and, to some degree, in a horizontal sense about the axle line 22.

Obstructive material in the form of anti-dive screens 50 and 52 made from mesh material 54 is attached to the buoyant bodies 16, 18, etc. so that, in use, the anti-dive screens extend downwardly from the buoyant bodies. The screens are in two horizontal rows. An upper row 50 is directly attached at fixing points 56 to the various buoyant bodies. The anti-dive screens 52, which are lower than the screens 50, are attached to the screens 50 at pivot points 60. The arrangement is one in which, as is indicated in FIG. 2, the screens 50 can pivot to some extent relative to the buoyant bodies 16 etc. while the screens 52 can, similarly, pivot to some extent relative to the anti-dive screens 50.

Referring to FIG. 1 the buoyant bodies 16, 18 and 20, viewed from one side, extend over a length A. The anti-dive screens below these bodies extend over a length B which is greater than A. Consequently when the modules 12 and 14 are connected to each other, as is shown in FIGS. 1 and 3, end portions of the anti-dive screens overlap each other at a junction 64. This means that the anti-dive screens, below the buoyant bodies, form a continuous barrier along the length of the interconnected buoyant bodies.

Figure 4:
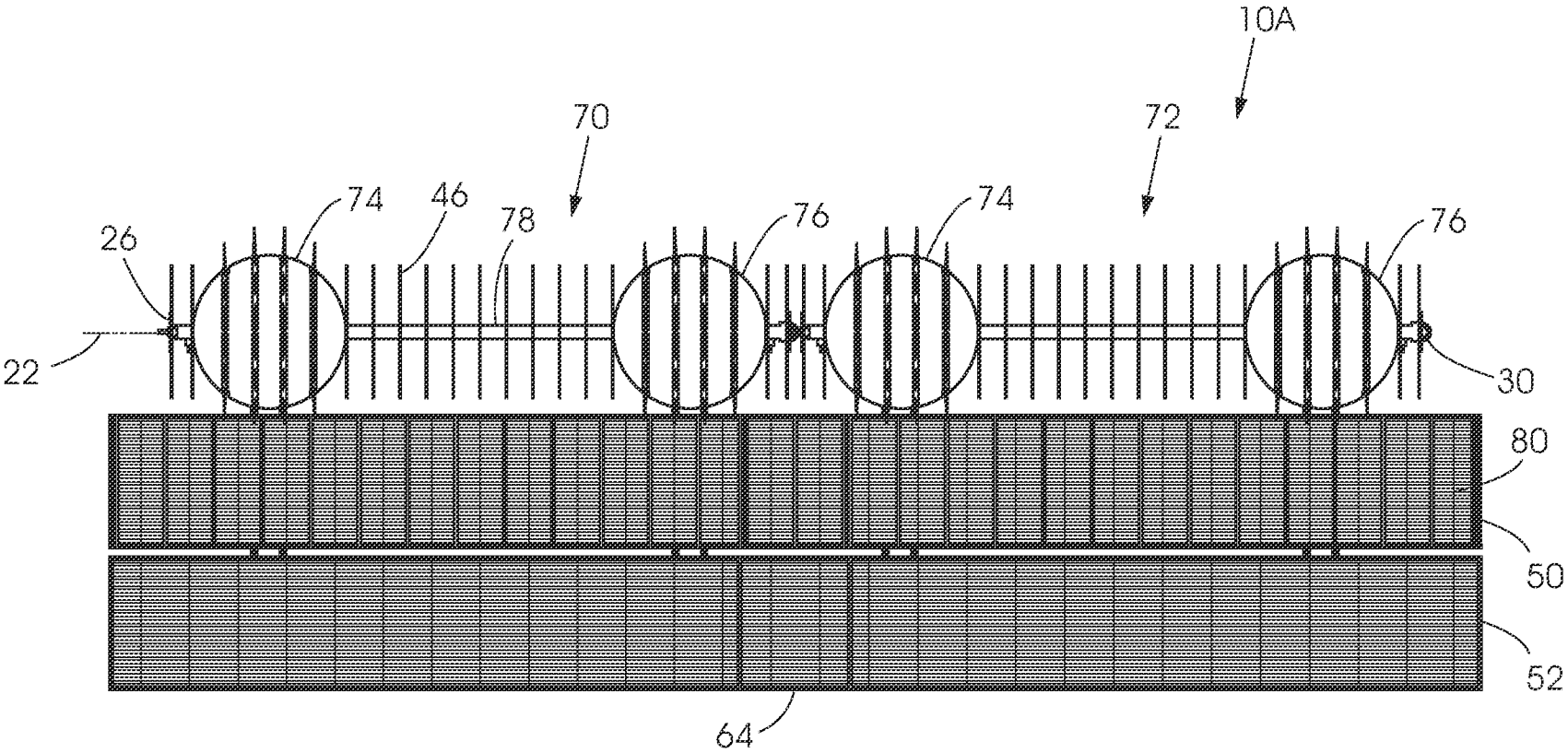
FIG. 4 is similar to FIG. 1 illustrating a barrier according to a second form of the invention.
Figure 5:
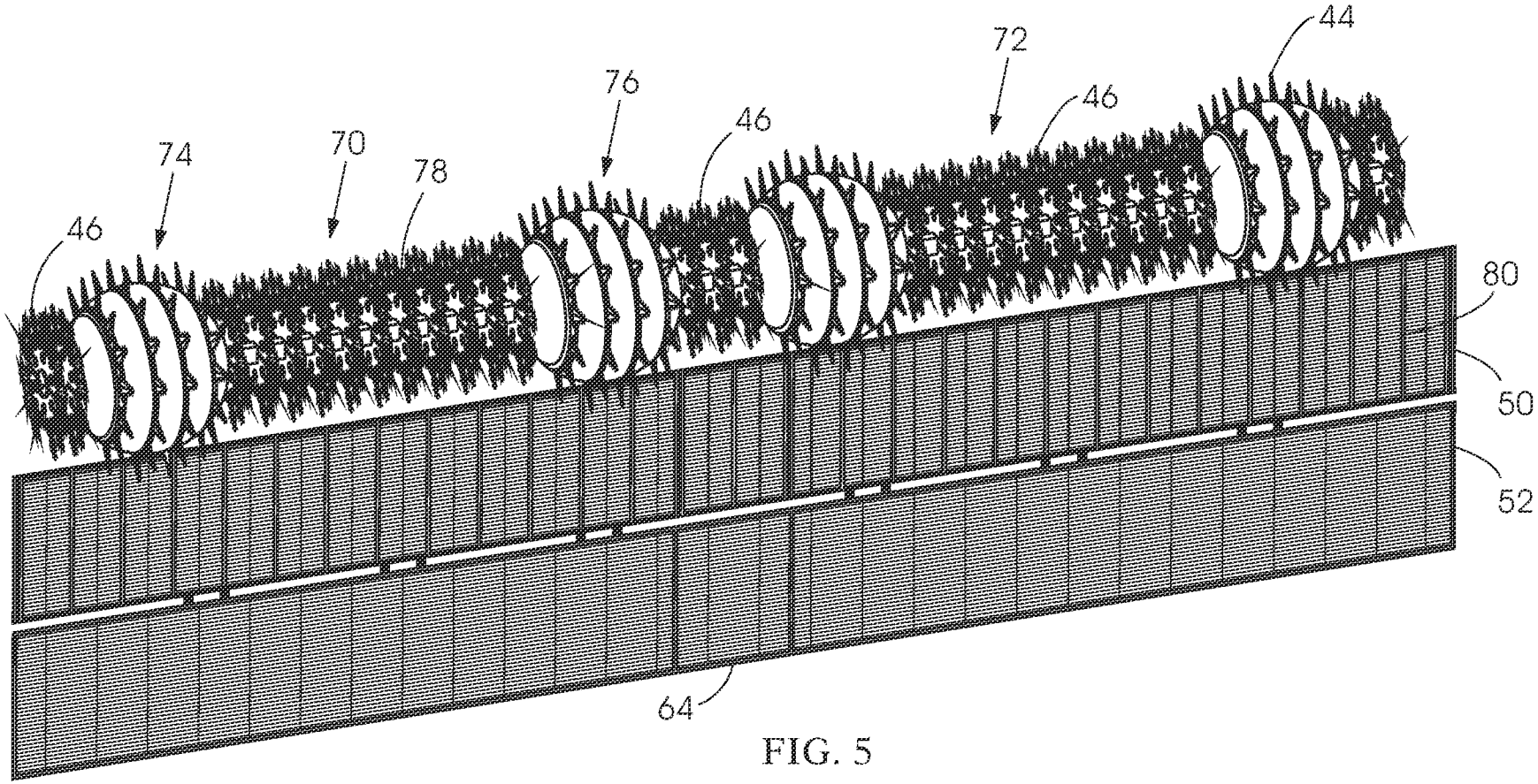
FIG. 5 shows the barrier of FIG. 4 in perspective.

FIGS. 4 and 5 illustrate a different barrier 10A which has some similarities to the barrier 10 and thus, where applicable, like reference numerals are used to designate like components. In this instance the barrier 10A is formed from modules 70 and 72 etc. which are substantially identical to each other. Each module has two buoyant bodies 74, 76 and each body carries a plurality of deterrent components 44 as is the case in the embodiment in FIGS. 1 to 3. An elongate member 78 interconnects the buoyant bodies 74 and 76. The elongate member 78 is located on an axle line 22.

Opposing ends of the elongate member 78 carry coupling formations 26 and 30. Thus adjacent modules 70 and 72 etc. can be interconnected in the manner which has been described in connection with FIG. 1.

Extending downwardly from each module is obstructive material in the form of anti-dive screens 50 and 52. The dimensions are such that edges of the anti-dive screens overlap one another to close any gap which might occur at a junction 64. A substantial number of deterrent components 46 are fixed to the elongate member 78. The upper anti-dive screen 50, as is the case with what is shown in FIG. 1, is reinforced by means of a plurality of horizontally spaced apart rods or bars 80. This is to hinder cutting of the screen by an underwater perpetrator.

Figure 6:
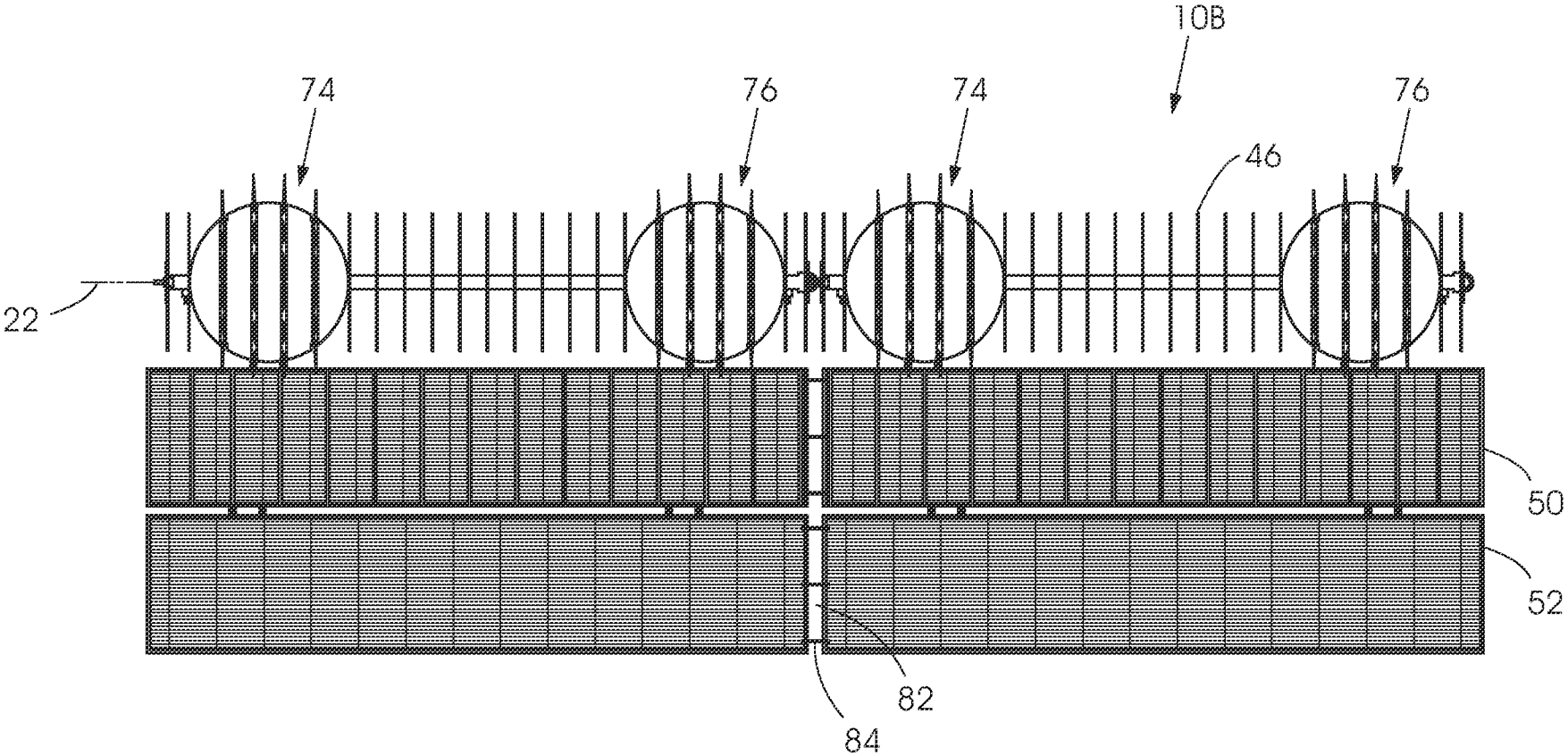
FIGS. 6 to 9 illustrate further variations of the invention.

FIG. 6 illustrates an embodiment 10B which is similar in many respects to the embodiment shown in FIG. 4. However the anti-dive screens do not overlap as is shown in FIG. 5 but instead are spaced apart from one another. A gap 82 between adjacent screens, in a horizontal sense, is closed by means of ties 84 which couple the adjacent screens together.

Figure 7:
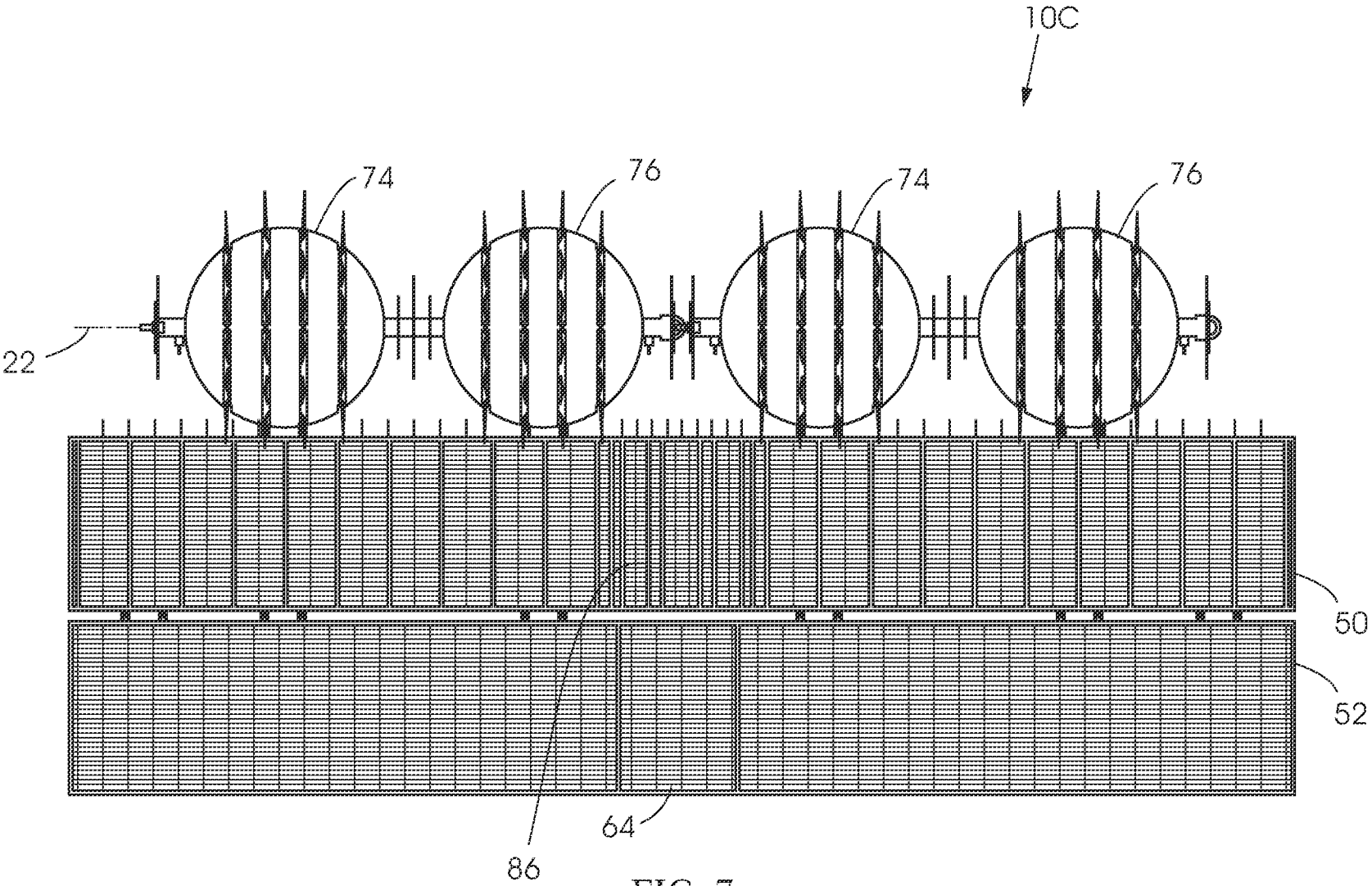

FIG. 7 illustrates a part of a barrier 10C which is similar in many respects to what is shown in FIG. 4. However the buoyant bodies are closer to one another than what is the case in FIG. 4 and, moreover, a part of the junction 64, between overlapping ends of the anti-dive screens 50 and 52, is reinforced by means of bars or rods 86 to prevent the creation of a gap between the adjacent screens by a perpetrator.

Figure 8:
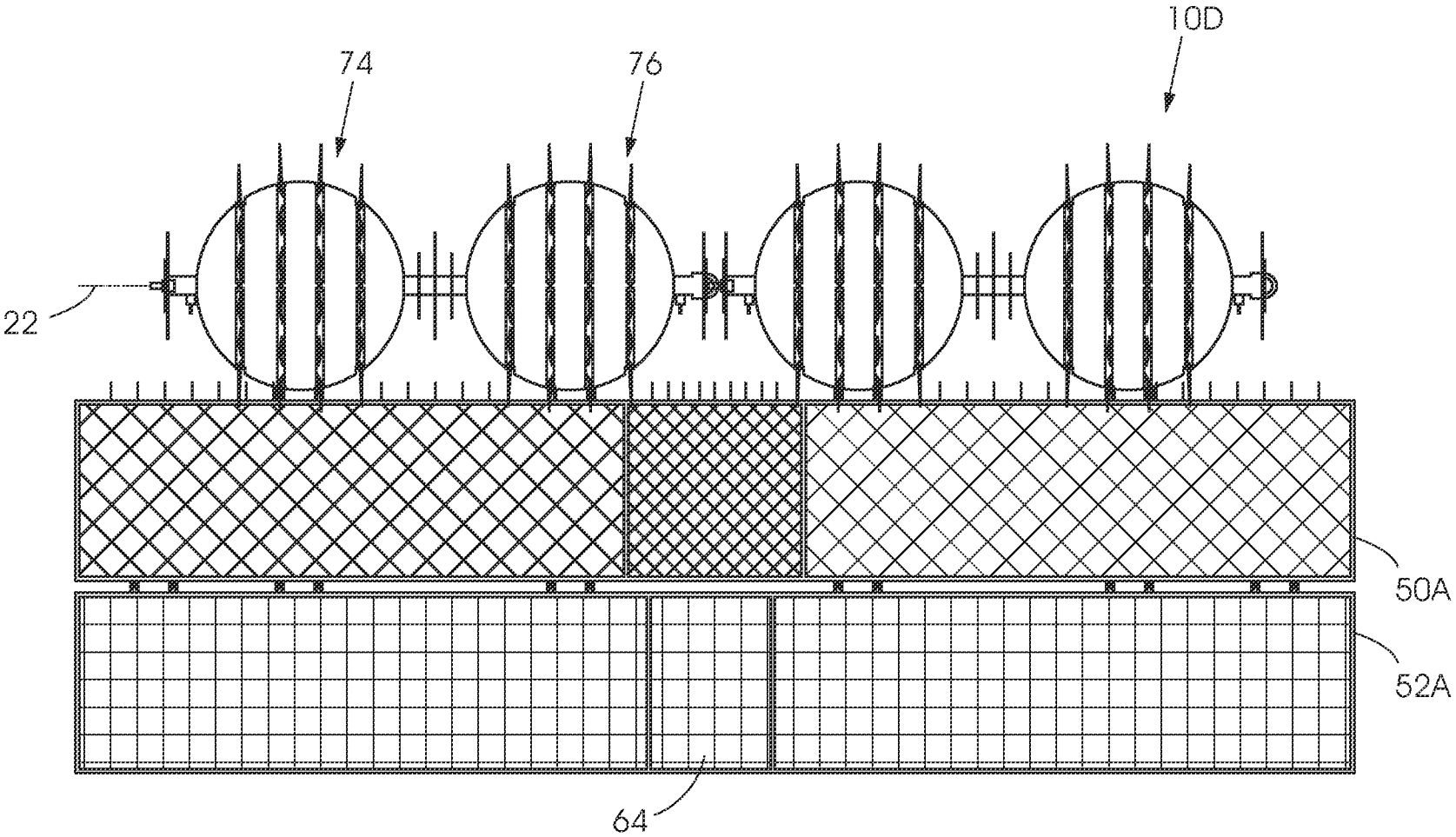

FIG. 8 shows a part of a barrier 10D which conceptually is similar to what is shown in the preceding drawings. However the anti-dive screens designated 50A and 52A have substantially different mesh configurations. The screen 50A has a relatively high mesh density because, as is explained hereinafter, this screen, in use, is fairly close to a surface of a body of water in which the barrier 10D is positioned. The lower anti-dive screen 52A has a lower mesh density—in use this anti-dive screen is deeper in the water and, at least for that reason, it would be more difficult to penetrate. This arrangement helps to conserve material and thus lowers cost.

Figures 9, 10:
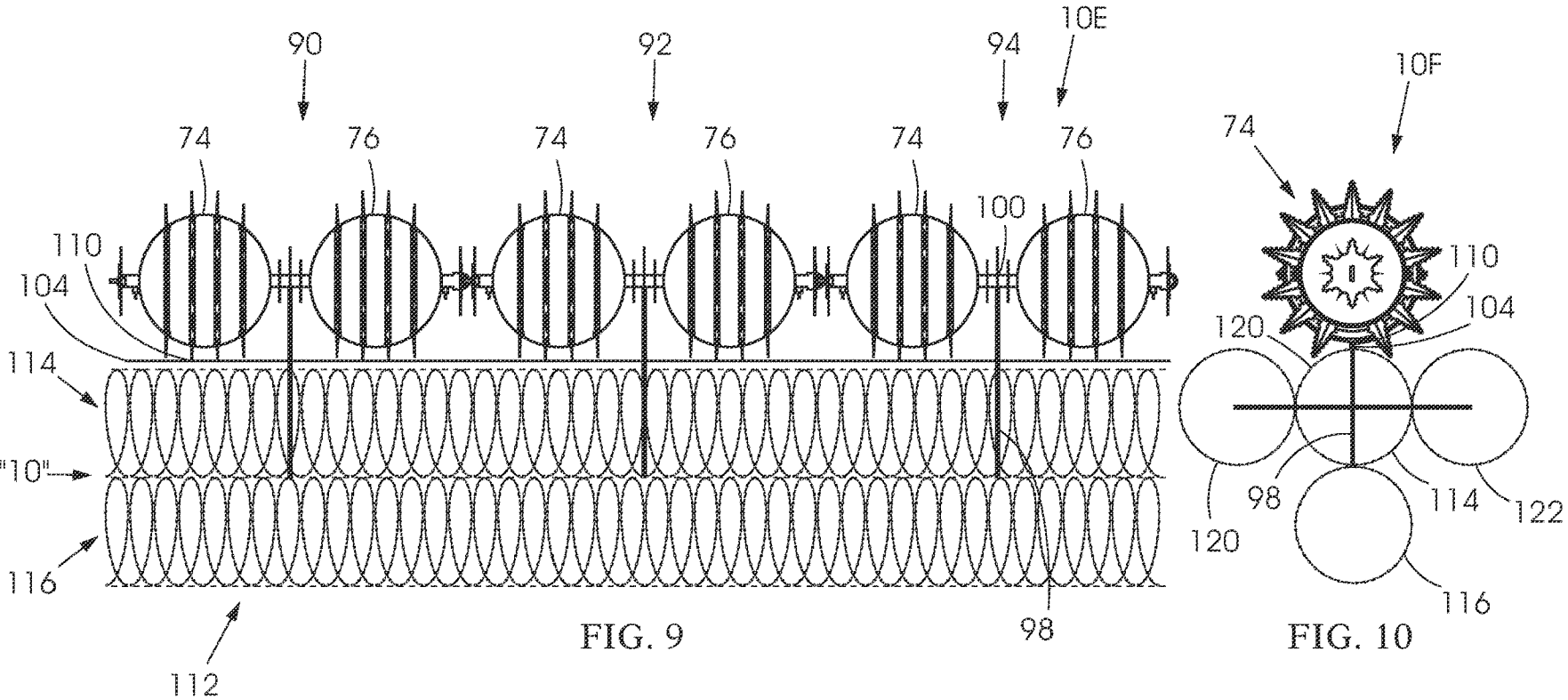
FIG. 10 is a view of the barrier in FIG. 9 in the direction of an arrow marked 10.

FIG. 9 illustrates from one side a part of a barrier 10E according to the invention which is constructed from interconnected barrier modules 90, 92, 94 etc. Again where applicable like reference numerals are used to designate like components and such components are therefore not further described herein.

Stabilising rods 98 extend downwardly from elongate members 100 which fix adjacent buoyant bodies, in each barrier module 90, 92 etc., to one another. An elongate cable 104 is attached to fixtures 110 on the individual buoyant bodies so that it extends horizontally.

The anti-dive screens 50, 52 are replaced by obstructive material in the form of coils 112 which are attached to the cable 104 and to the stabilising rods 98. In this example there are two horizontally extending coil arrays 114, 116 with a lower array fixed to an upper array. The coils 112 can be in helical form or can be in so-called "flat-wrap" form produced by flattening adjacent coils of a helical array so that the windings are essentially coplanar and then fixing adjacent coplanar windings to one another. This results in a tight mesh configuration.

FIG. 10 shows a modification 10F wherein, in order to restrict access to sides of the barrier 10E, blocking material in the form of coils 120, 122 of helical windings is fixed to opposing sides of the buoyant bodies.

In order to enhance the deterrent effect of the barrier 10F the coils 112, 120, 122 can be formed from razor wire, barbed wire or the like. This type of feature may be required in high security applications.

Figure 11:
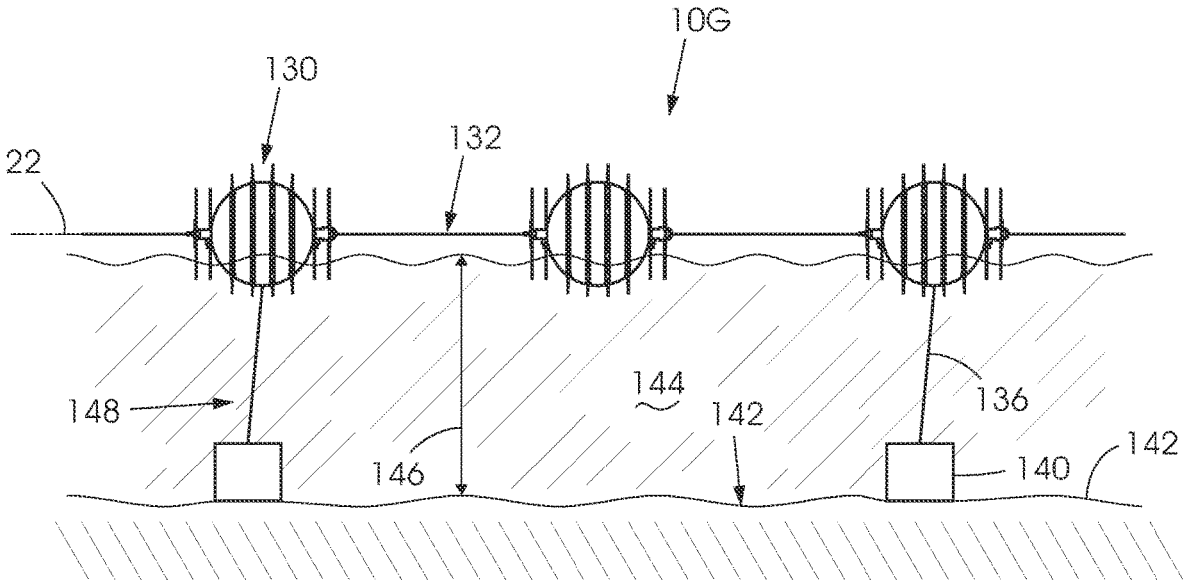
FIG. 11 illustrates how a barrier according to the invention can be anchored in position in a body of water.

FIG. 11 schematically illustrates how a barrier, designated 10G, is used in practice. The buoyant bodies 130 are of the kind described in any of the preceding examples and are connected abutting each other or, as is shown, are connected by means of elongate members 132. It is to be borne in mind that FIG. 11 is exemplary only. FIG. 11 does not illustrate the anti-dive material which is suspended below the buoyant bodies.

Fixing cables 136 are attached to some of the buoyant bodies 130 or to the members 132 (not shown). Each cable 136 at a lower end is attached to an anchor 140 of any appropriate kind. In use the anchor 140 rests on and digs into the earth or ground 142 below a body 144 of water upon which the buoyant bodies float. The cables have a length which is approximately three times the depth 146 of the water at each installation location. This allows the cables to move laterally with current flow 148 in the water and, if the water level rises significantly, due to rain or other seasonal effects, each buoyant body 130 can move accordingly.

The buoyant bodies are erected in the body 144 of water which, typically, is a river between two adjacent countries, or which is at a harbour or other marine installation or at a dam or lake. Usually the buoyant bodies form an elongate barrier zone which is more or less at a centre of the river extending along the length of the river. The width of the barrier zone is determined by the nature of the components used in the construction of the barrier. Due to the deterrent components 44 and 46 (not shown in FIG. 11) it is difficult for a boat or a person to pass over the buoyant bodies. Additionally due to the mesh material which extends downwardly from the buoyant bodies it is difficult for a person to swim underneath the barrier.

Figure 12:
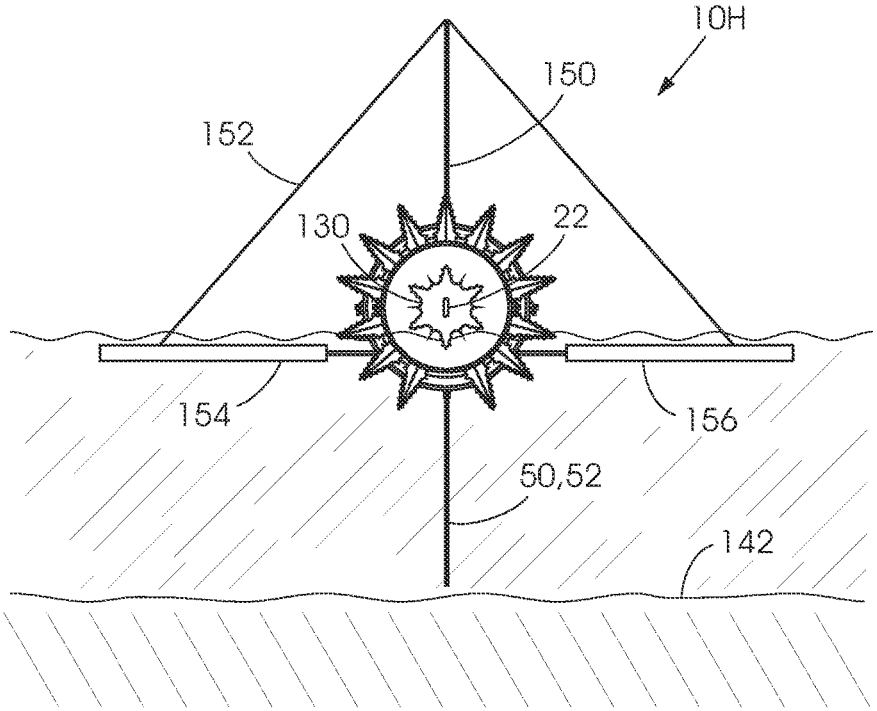
FIG. 12 shows a modification to the barrier of the invention intended to restrict access to the barrier from each side thereof.

FIG. 12 shows an arrangement 10H in which access to sides of the buoyant bodies 130 is restricted. Vertically extending rods 150 are fixed to the buoyant bodies 130. Ties 152 attached to the rods 150 flare outwardly from the rods and, at their lower ends, are attached to blocking material in the form of mesh material 154 on one side of the buoyant bodies and mesh material 156 on an opposing side of the buoyant bodies. This arrangement makes it difficult for a person coming from either side to approach the buoyant bodies. The effective width of the barrier zone is thereby increased and it is difficult for a person coming from either side to approach the buoyant bodies. A similar restrictive effect is exhibited in respect of a watercraft which may attempt to reach the buoyant bodies.

Figure 13:
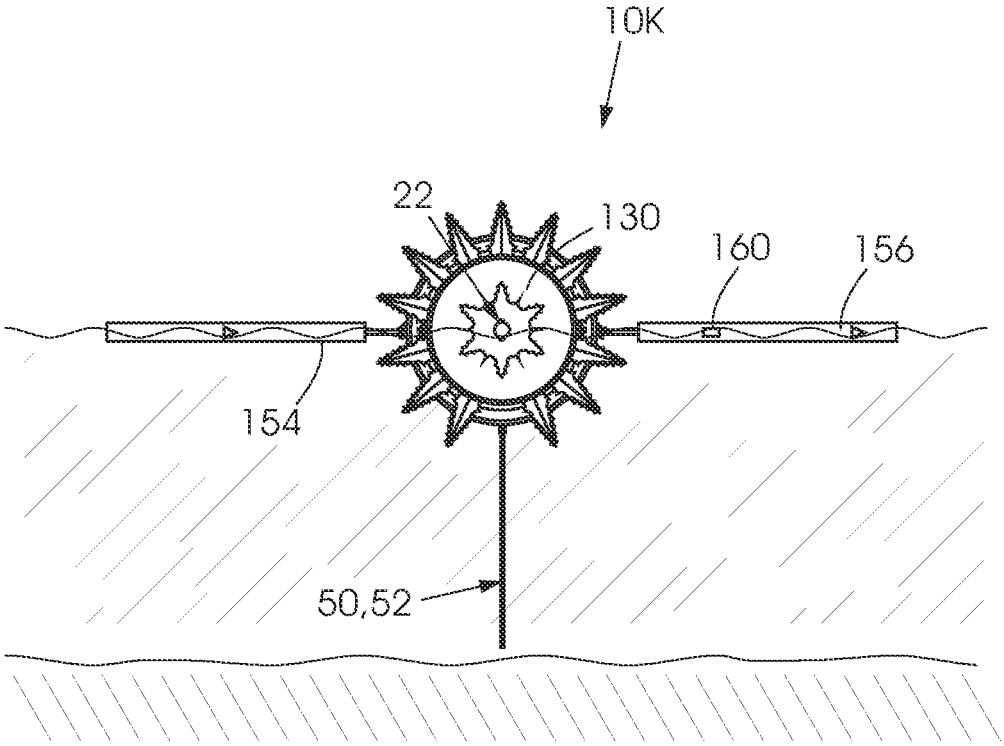
FIG. 13 shows a modification of the concept in FIG. 12.
Figure 14:
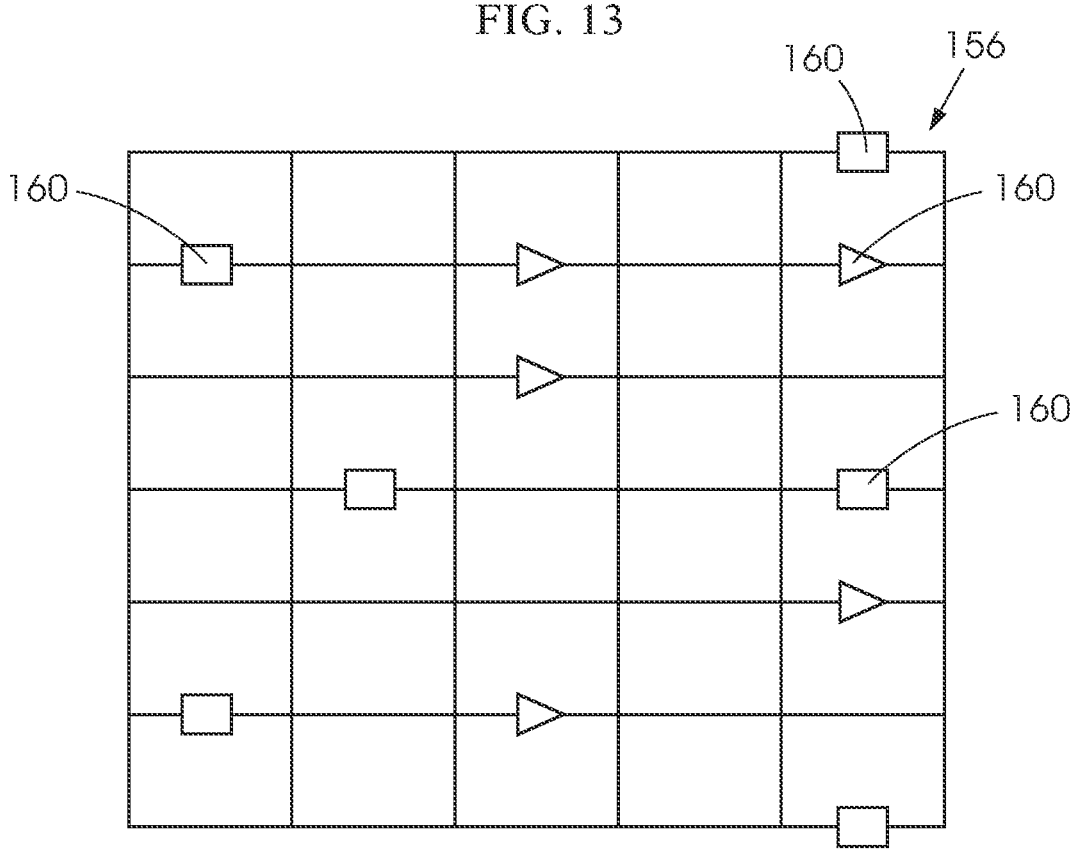
FIG. 14 is a plan view of blocking material used in the configuration shown in FIG. 13, FIGS. 15, 16 and 17 are plan, side and end views respectively of a different barrier according to the invention.

FIG. 13 shows a barrier 10K which conceptually is similar in many respects to what is shown in FIG. 12. However the upwardly extending rods 150 and the ties 152 are not used. Instead the mesh materials 154 and 156 which act as blocking components, carry a large number of relatively small float elements 160 (shown in plan view in FIG. 14) so that the density (specific gravity) of the blocking mesh materials 154 and 156 is significantly reduced. The blocking materials can therefore float in the water extending outwardly from the buoyant bodies. This feature makes it difficult for a person or a watercraft to breach the barrier 10K.

Figure 15:
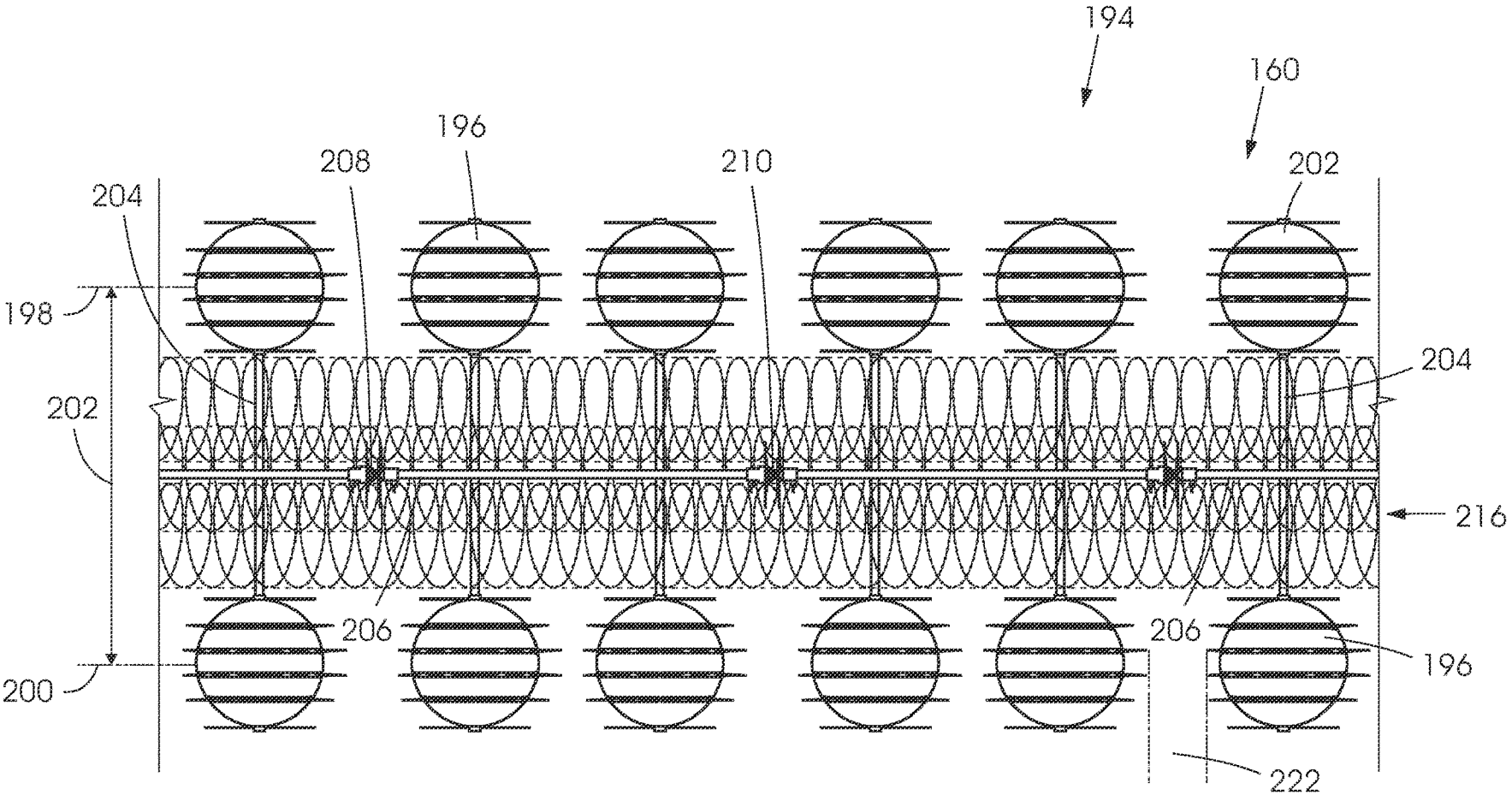
Figure 16:
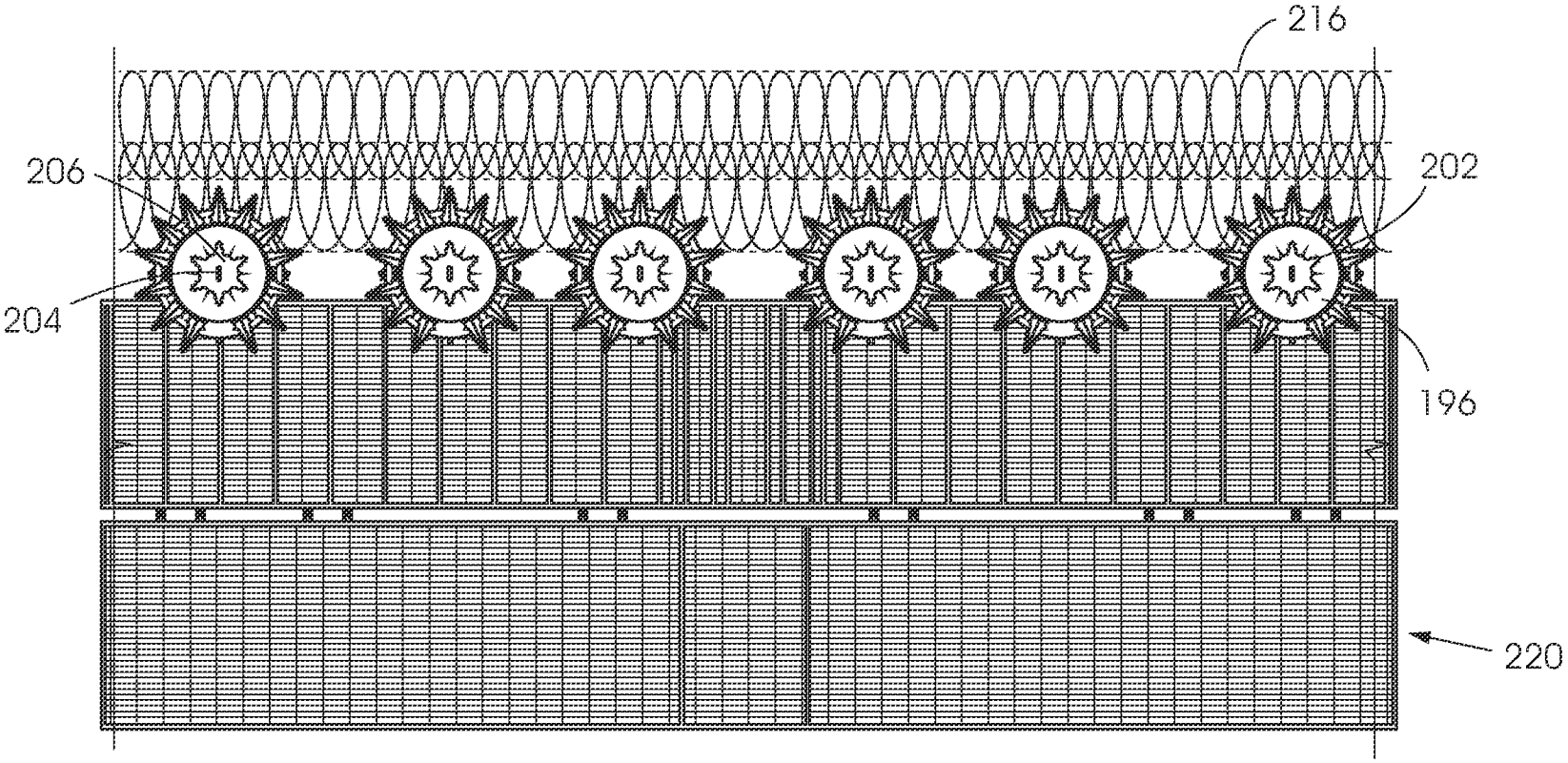
Figure 17:
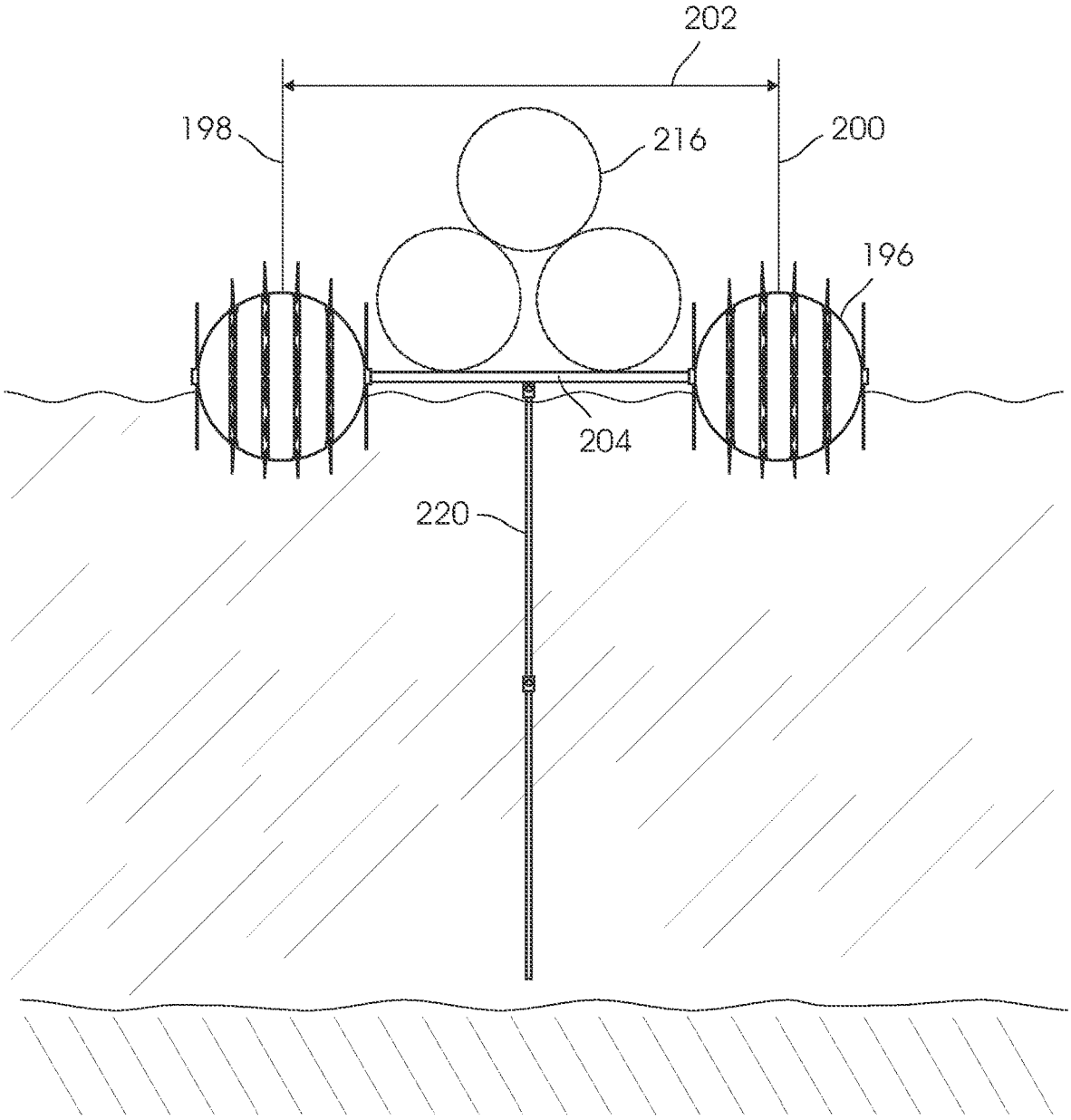

FIGS. 15, 16 and 17 are plan, side and end views respectively of a barrier 194 according to another form of the invention. The barrier 194 includes a number of spherical buoys 196 which, optionally, carry spikes or the like. The buoys 196 are positioned in two spaced apart and parallel lines 198 and 200 respectively. The lines are spaced apart by a distance 202.

Pairs of opposed buoys 196, in the lines 198 and 200, are fixed, preferably rotatably, to respective opposed ends of a transversely extending axle 204.

A crosspiece 206 is fixed at a central position to the axle 204 and extends transversely to the axle in opposing directions therefrom. At respective ends of the crosspiece 206 coupling formations 208 and 210 are secured. These are not shown in detail but they are of the kind described hereinbefore in that one formation is complementary to the other. This feature enable adjacent crosspieces to be connected to each other in a manner which allows one crosspiece to pivot to a limited extent relative to an adjacent crosspiece viewed in plan and from the side.

Concertina coils 216 are positioned on tops of the axles 204 (see FIG. 17) and extend in a longitudinal direction parallel to the lines 198 and 200 of the buoys 196. The coils 216 are between these lines. Obstructive material in the form of mesh material 220 is fixed to the axles 204 or to the crosspieces 206 and, in use, extends downwardly. The obstructive material can have the features which have been described hereinbefore.

In the barrier 194, in each of the lines 198 and 200, the buoys 196 are spaced relatively far apart from one another in a longitudinal direction by a distance 222 which may if required exceed the diameter of each buoy. Thus the coils 216 are clearly visible from each side of the barrier and can be accessed. However, in use, given that the buoys are floating in a body of water and that the coils are usually above the water level, it would be difficult for a perpetrator to climb over the coils. Equally it would be difficult for a perpetrator to swim below the coils for the obstructive mesh material 220 provides a significant deterrent.

The coils 216 could be made from plain wire or could have barbs or the like.

The relatively large spacing 202 between the lines 198 and 200 of the coils means that the barrier 194 has a significant width which enables multiple parallel coils 216 to be incorporated into the barrier.

Figure 18:
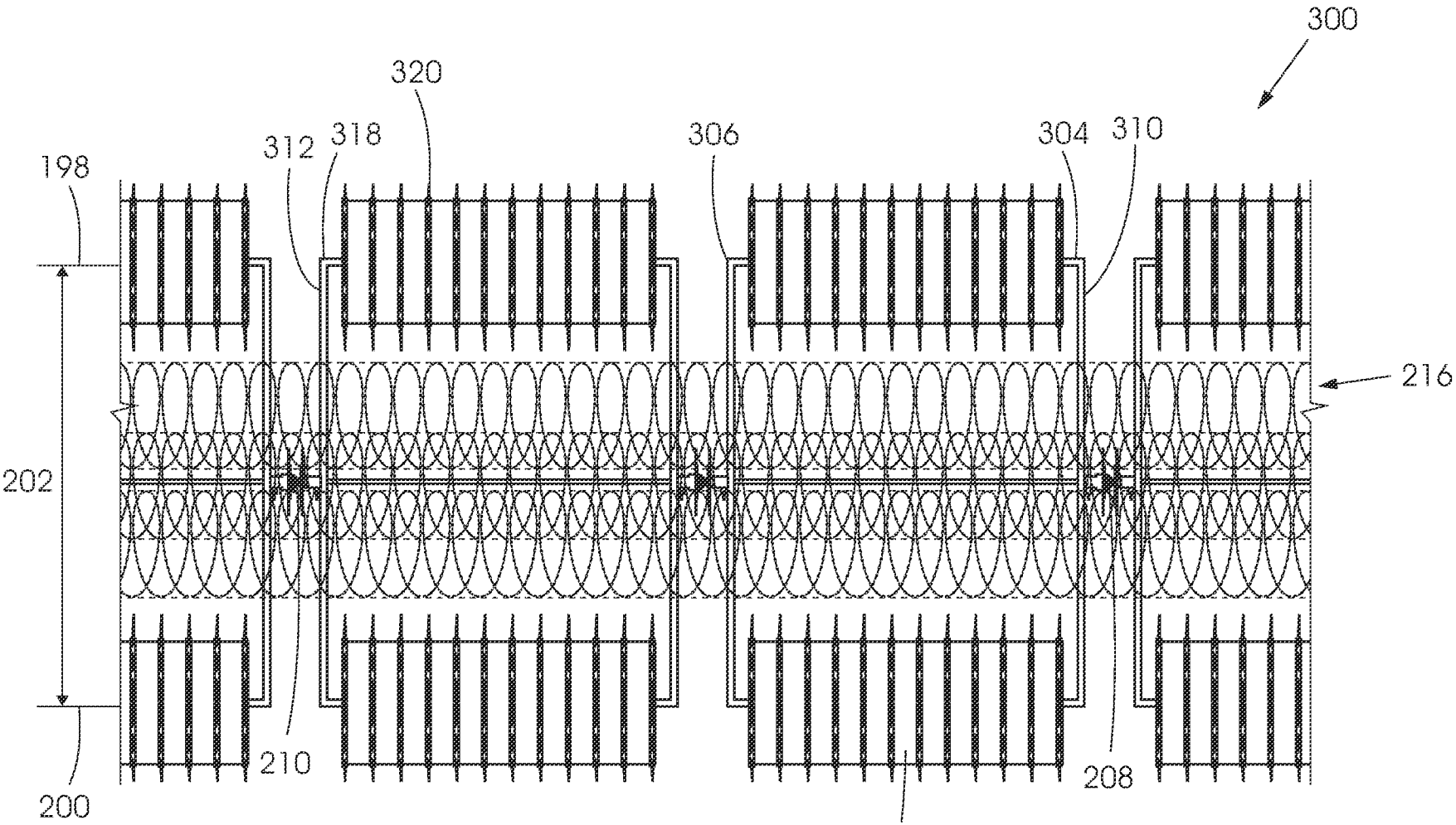
FIGS. 18, 19 and 20 are plan, side and end views respectively of another barrier according to the invention.
Figure 19:
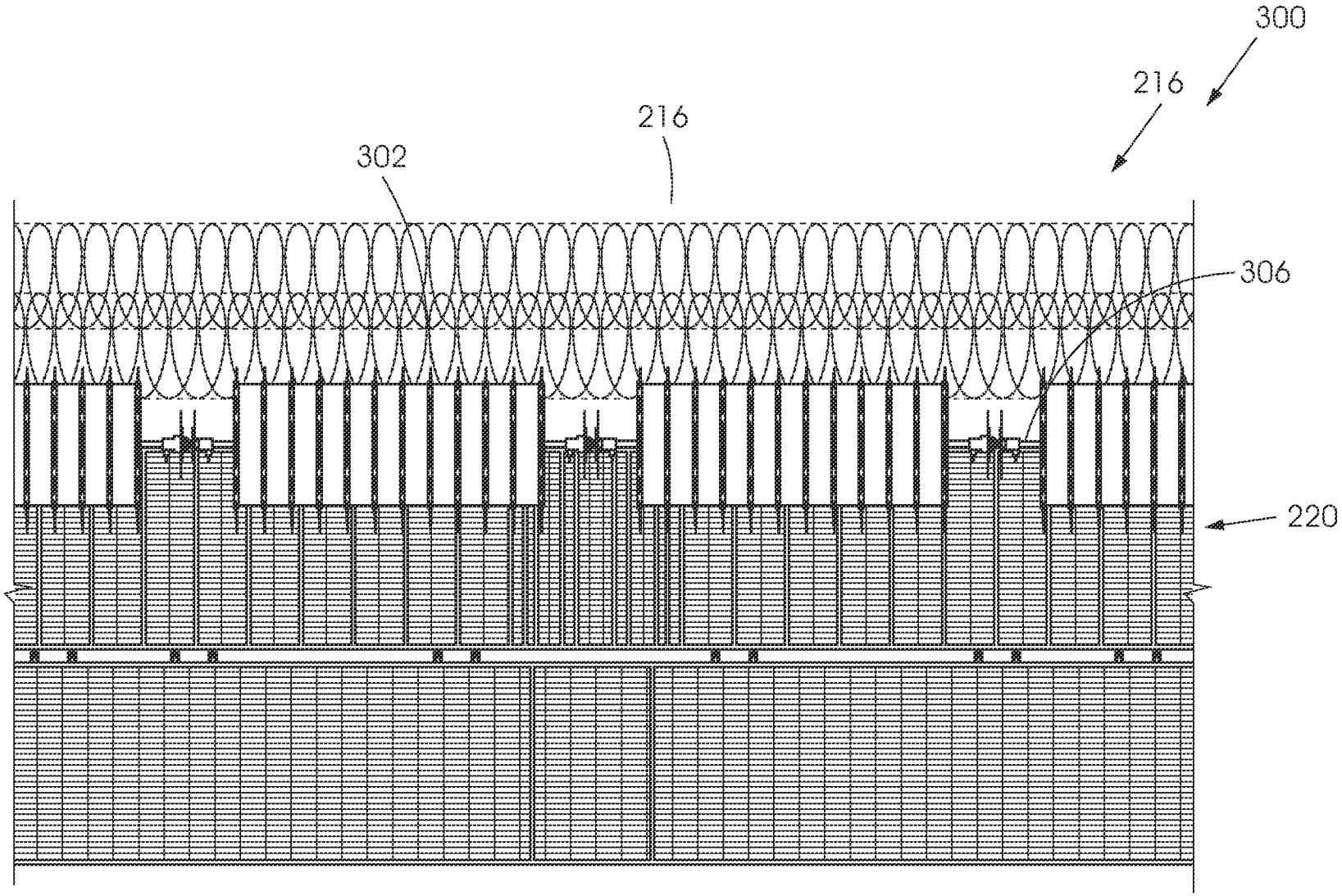
Figure 20:
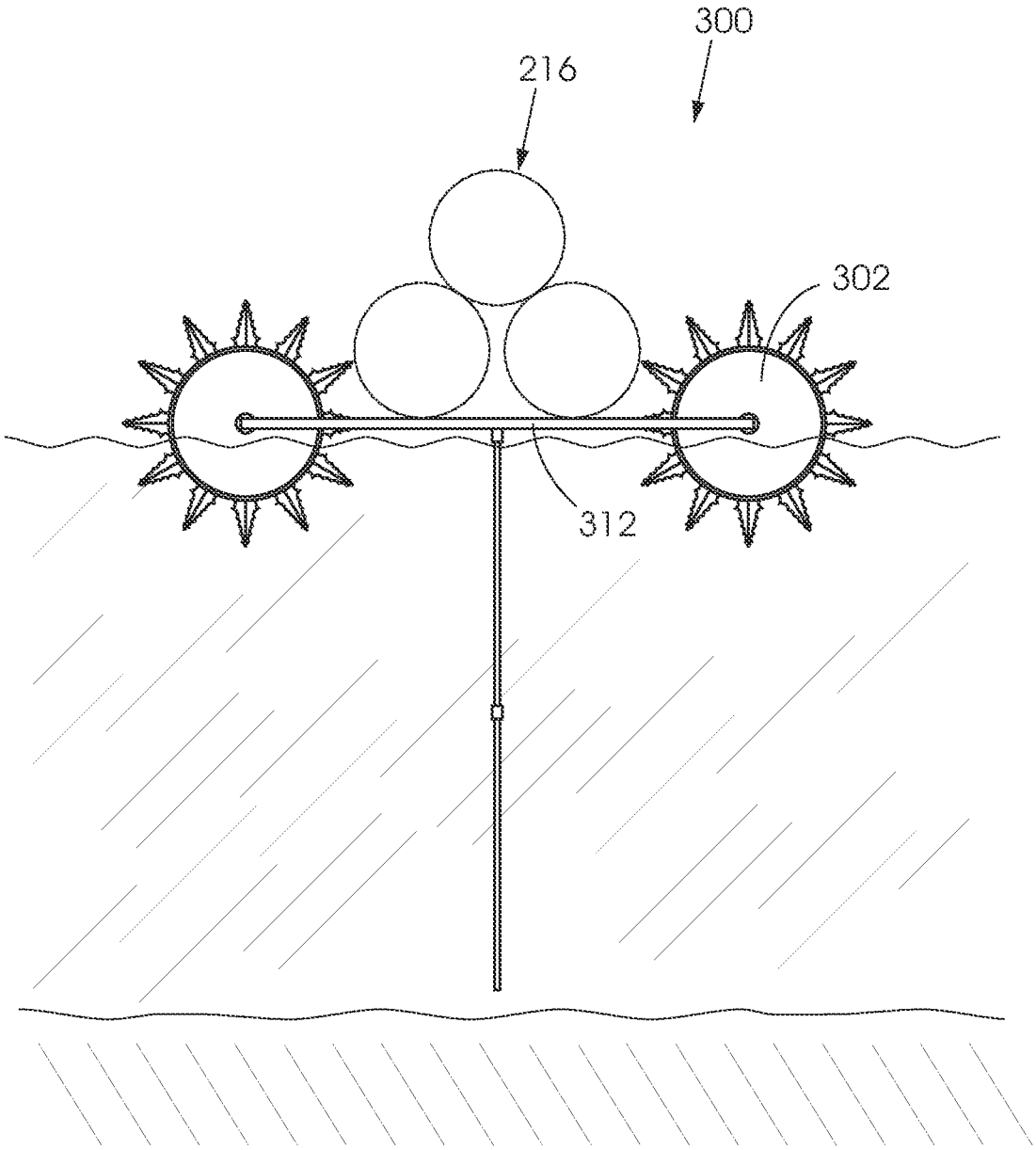

FIGS. 18, 19 and 20 show an arrangement 300 according to the invention which in many respects is similar to that described in connection with FIGS. 15, 16 and 17. For this reason components which are identical are not described and are designated with like reference numerals.

The spherical buoys 196 are replaced by elongate cylindrical buoys 302. Each buoy 302 is positioned, preferably rotatably, between a respective pair of stub-axles 304, 306 at opposed ends of a respective pair of transversely extending beams 310, 312. Central points of each of the beams 310, 312 carry respective coupling formations 208, 210 which are generally of the kind described hereinbefore and which enable adjacent beams to be pivotally interconnected to one another. The barrier 300 has the benefit that the cylindrical buoys 302 form a substantially continuous impediment which makes it difficult for a person in the water to reach the concertina coils 216 which are mounted on top of the beams between the two lines 198, 200 of the buoys 302. The coils can thus comprise barbed tape or the like for it is extremely unlikely that a person in the water could inadvertently come into contact with the coils. The barrier 300 is difficult for a watercraft to breach. Optionally, as shown, the buoys 302 could carry protruding spikes 320 or the like.

Figure 21:
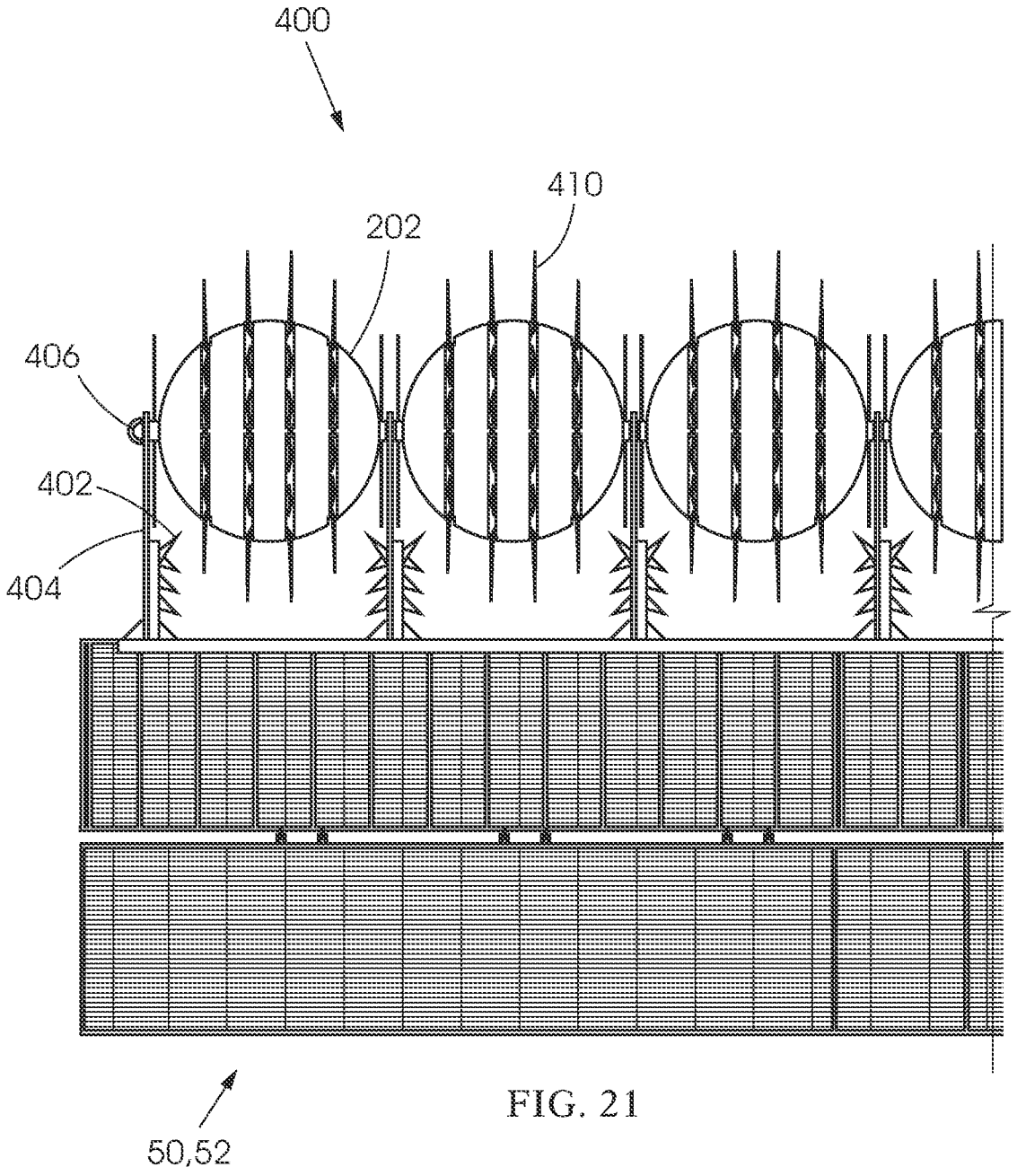
FIGS. 21 and 22 illustrate further variations of the invention.

FIG. 21 shows a further embodiment 400, of the invention. Components which are similar to components already described have like reference numerals.

Deterrent spikes 402 are fixed to rods 404 which extend downwardly from an axle 406 to which buoys 202 are attached. Anti-dive screens 50, 52 are mounted to the rods 404. It is thus difficult for an intruder to move through the space between the buoys and the screens.

Another modification is to reduce the radial lengths of spikes 410 on the buoys 202 to form what may be referred to as serrations spaced apart by, say, 15 mm and with radial heights of about the same dimension. The serrations are less likely to cause bodily harm to an intruder but nonetheless retain characteristics which are sufficiently aggressive to deter hand contact.

Figure 22:
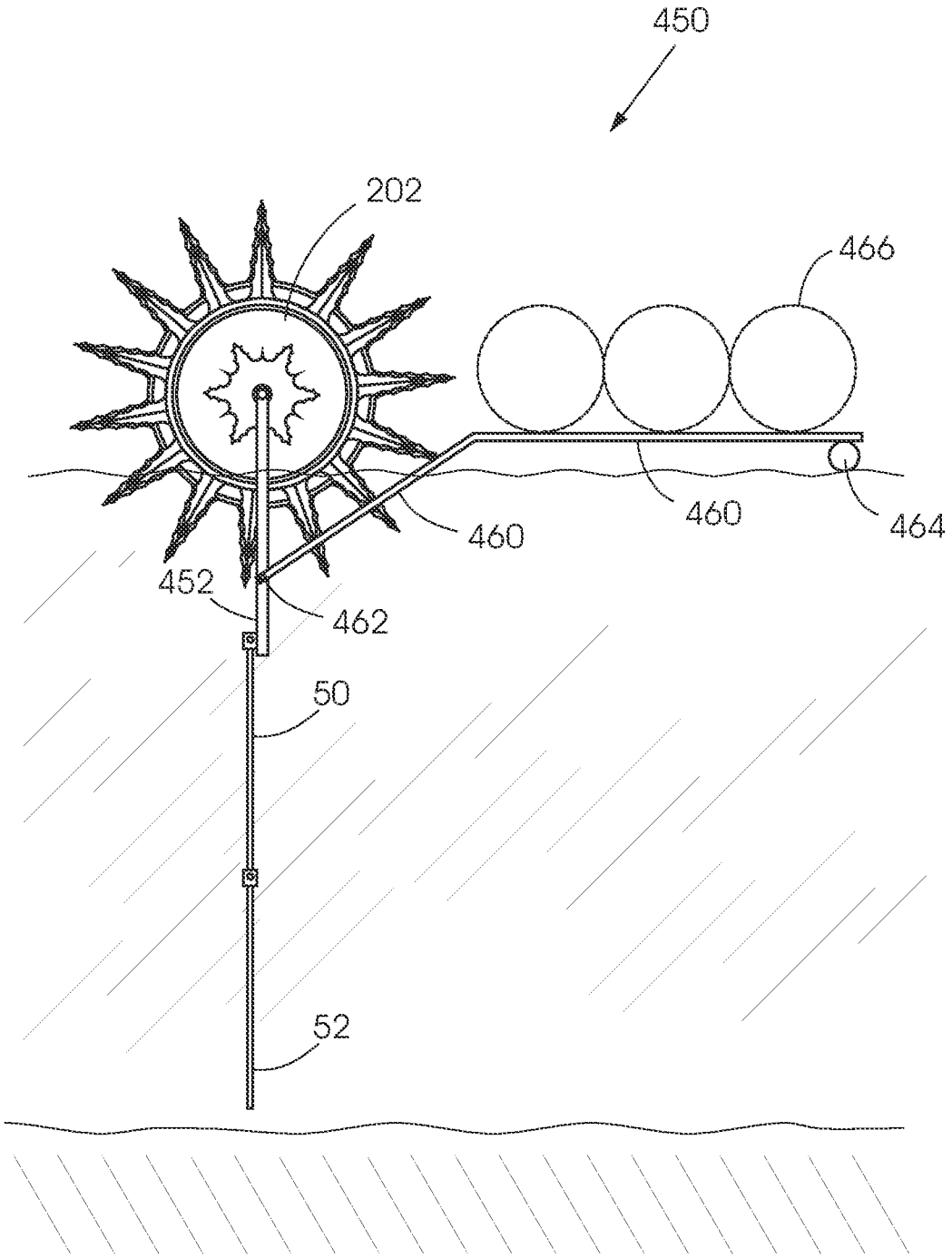

FIG. 22 is an end view of an arrangement 450 wherein anti-dive screens 50, 52 extend downwardly from rods 452 attached to buoys 202. Frames 460 are attached to the rods 452 at pivot points 462 and project to one side of the buoys 202. Floats 464 are fixed to the frames and razor wire coils 466, on top of the frames, adjacent the buoys, then present a formidable barrier to a watercraft or to a person trying to cross over the arrangement 450.

The buoyancy offered by the floats 464 is such that the razor wire coils 466 are kept more or less at the surface of the water. If an intruder stands on the floats 464 or on the frames 460 in an attempt to cross over the buoys 202 the floats and the razor wire coils sink into the water. Thus the frames and floats do not offer any meaningful assistance to any person trying to penetrate the barrier.

The anti-dive screens 50 and 52 can attached, directly, to the buoys (in any embodiment) or to the axles to which the buoys are mounted. The axles, as far as possible, should be rotatably attached to the anchors which keep the barrier in position. The spikes or deterrent materials on the buoys or between the buoys should also be rotatable and so should the buoys.

In some of the embodiments, for example in the embodiment shown in FIGS. 15 to 20 sensor wires, not shown, can be positioned inside the coils. An intruder attempting to penetrate the coils would inevitably have to cut the sensor wires and in this event an alarm can be triggered at a remote location so that appropriate reactive action can be taken.

The invention claimed is:

1. A barrier for restriction of passage across or through a body of water, the barrier comprising:

a plurality of buoyant bodies;

an elongate member that connects the buoyant bodies to one another in at least one elongate axle line in a longitudinal array, wherein each of the plurality of buoyant bodies is rotatable about the elongate member; and a plurality of deterrent components directly mounted to the elongate member between respective adjacent pairs of the buoyant bodies;

wherein each deterrent component of the plurality of deterrent components is rotatable relative to the elongate member and the respective adjacent pair of the buoyant bodies.

2. The barrier according to claim 1, wherein the plurality of buoyant bodies is formed in two or more spaced apart elongate axle lines which are parallel to one another and are connected to one another, and wherein deterrent material is placed between the lines of buoyant bodies.

3. The barrier according to claim 1, further comprising apertured obstructive material which in use extends downwardly from the buoyant bodies to inhibit a person from swimming below the buoyant bodies.

4. The barrier according to claim 3, wherein the obstructive material is selected from a plurality of sheets of mesh, and coils of wire.

5. The barrier according to claim 3, further comprising blocking material, at least on one side of the longitudinal array, wherein the blocking material extends transversely to the obstructive material at a surface of the body of water, the blocking material being selected from mesh, wire and wire coils.

6. The barrier according to claim 3, wherein the obstructive material comprises, adjacent the buoyant bodies, first sheets of mesh material with a first mesh density and second sheets of mesh material suspended from the first sheets, wherein the second sheets of mesh material have a second mesh density which is less than the first mesh density.

7. The barrier according to claim 3, wherein the obstructive material is pivotal relative to the buoyant bodies to a limited extent.

8. The barrier according to claim 3, wherein the obstructive material is selected from a plurality of sheets of mesh, and coils of wire.

9. The barrier according to claim 1, wherein the buoyant bodies are spherical buoys.

10. The barrier according to claim 1, wherein the buoyant bodies are cylindrical in shape and are spaced in an end-to-end relationship.

11. The barrier according to claim 1, further comprising a plurality of anchors adapted to be received on ground below the body of water, and a plurality of flexible elements which fix the buoyant bodies to the anchors.

12. The barrier according to claim 1, further comprising deterrent components that differ from the plurality of deterrent components mounted to the elongate member and which are mounted to respective outer surfaces of the plurality of buoyant bodies.

13. The barrier according to claim 1, wherein each of the plurality of deterrent components is formed in the shape of a disc.

14. The barrier according to claim 1, wherein the plurality of buoyant bodies are spaced from one another by a distance that exceeds a diameter of each of the buoyant bodies.

* * * * *